US005243579A

United States Patent [19]

Potthof

[11] Patent Number: 5,243,579

[45] Date of Patent: Sep. 7, 1993

[54] ELECTRONIC APPARATUS FOR MONITORING THE REMAINING STORAGE PERIOD OF FROZEN FOODS

[75] Inventor: Erwin Potthof, Rothenbach, Fed. Rep. of Germany

[73] Assignee: Diehl GmbH & Co., Fed. Rep. of Germany

[21] Appl. No.: 875,524

[22] Filed: Apr. 27, 1992

Related U.S. Application Data

[63] Continuation of Ser. No. 553,889, Jul. 13, 1990, abandoned.

[30] Foreign Application Priority Data

Jul. 15, 1989 [DE] Fed. Rep. of Germany ..... 3923510

[51] Int. Cl.[5] ..... G04F 7/00

[52] U.S. Cl. ..... 368/107; 368/223

[58] Field of Search ..... 368/307, 107–113

[56] References Cited

U.S. PATENT DOCUMENTS

| | | | |
|---|---|---|---|
| 3,517,636 | 6/1970 | Colon-Morales | 368/107 |
| 3,932,823 | 1/1976 | Tamano | 368/109 |
| 3,940,918 | 3/1976 | Everson | 368/104 |
| 4,031,524 | 11/1981 | Koepp et al. | 368/261 |
| 4,619,221 | 10/1986 | Linstromberg | 116/307 |
| 4,896,307 | 1/1990 | Marx et al. | 368/106 |
| 4,995,018 | 2/1991 | Edwards | 368/107 |

FOREIGN PATENT DOCUMENTS 2856122 6/1980 Fed. Rep. of Germany .

*Primary Examiner*—Bernard Roskoski

*Attorney, Agent, or Firm*—Scully, Scott, Murphy & Presser

[57] ABSTRACT

An electronic apparatus for monitoring the remaining storage period of frozen foods. The apparatus includes an electro-optical display, a control electronics with a memory or data storage, input elements for entering the data with regard to the frozen foods (type of commodity, remaining storage period) as well as one switch element for initiating the storage of the data in the apparatus, and wherein subsequent to the input of the data regarding a commodity which is to be newly stored, there appears on the display an identification number which has not been taken as yet and which is assigned to these data, which is to be applied onto the commodity and serves for the later identification thereof in the freezer; and wherein, after the expiration of the remaining storage period, there is generated an applicable warning signal.

11 Claims, 5 Drawing Sheets

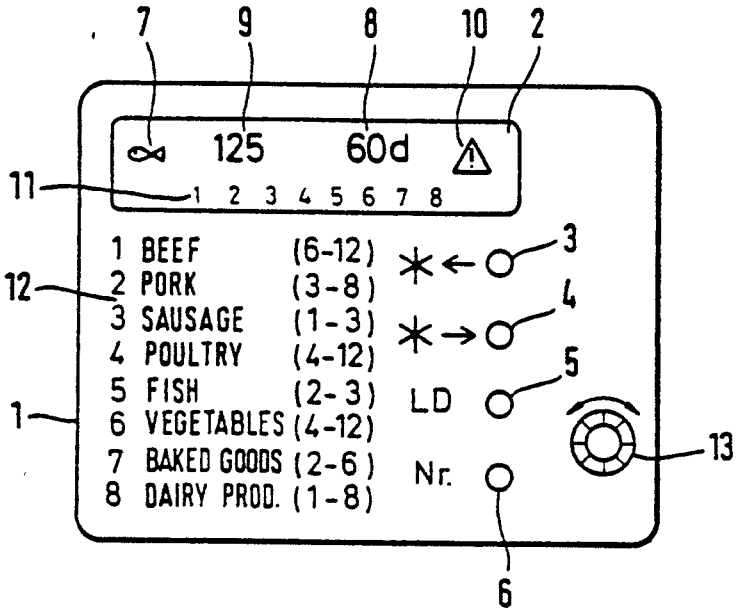
FIG.1
FIG.1a
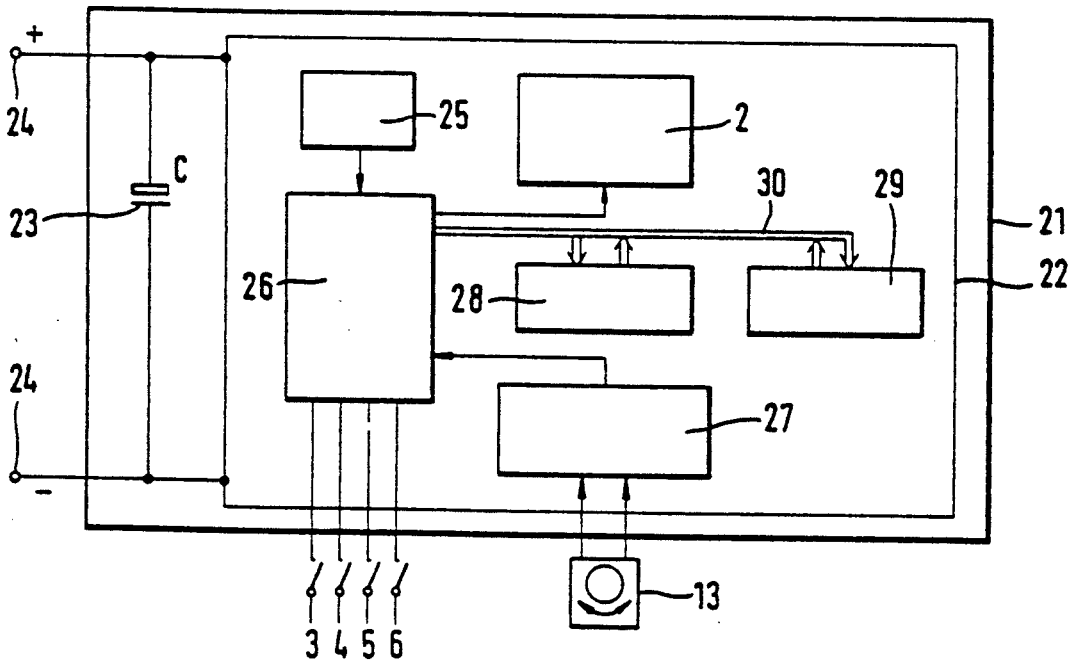

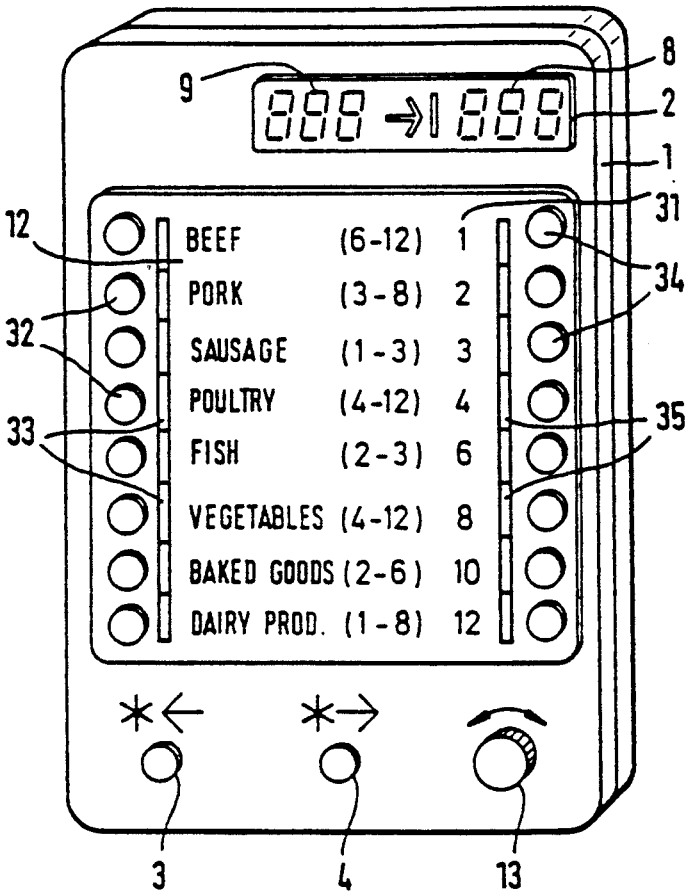
FIG. 2
FIG. 2a
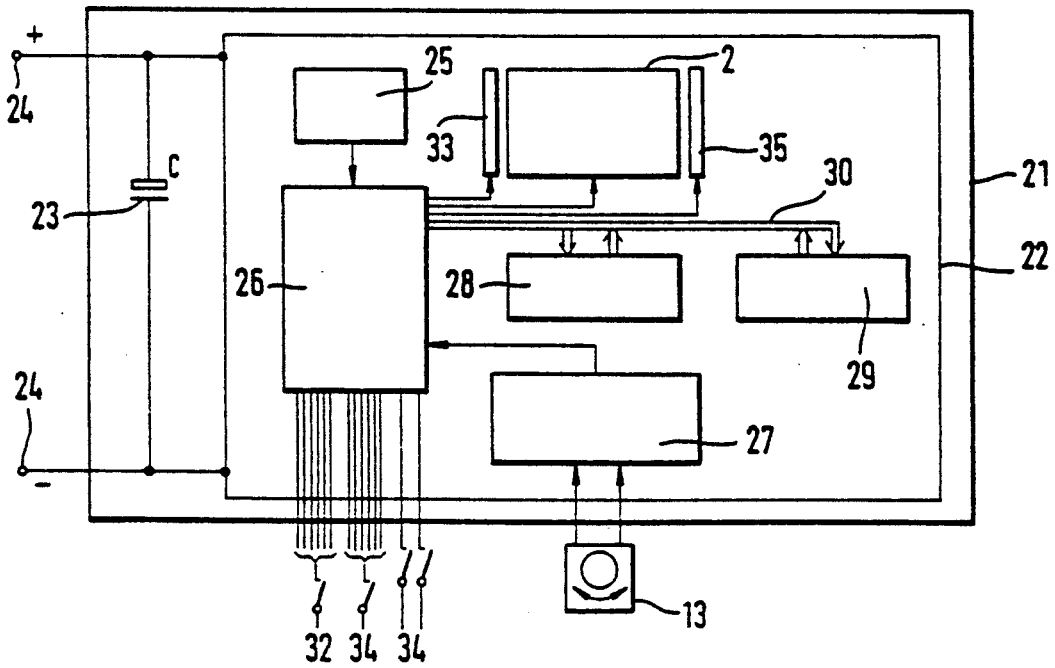

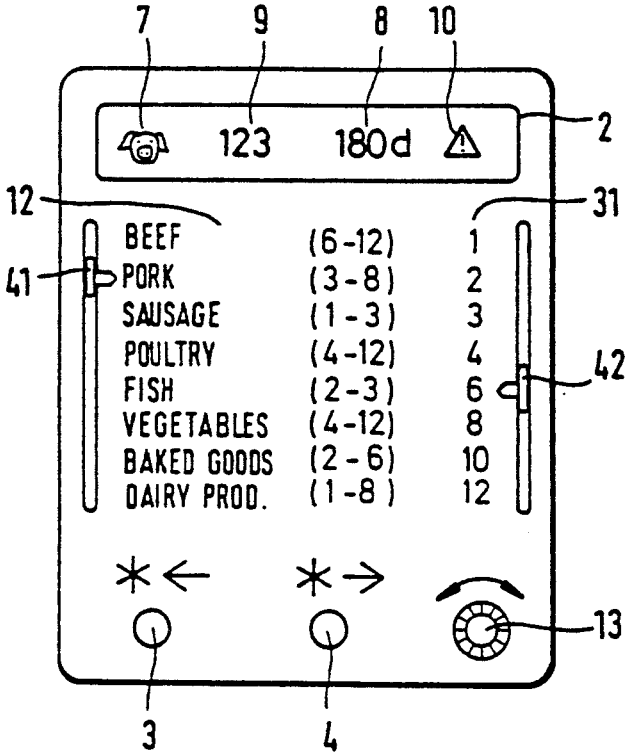
FIG. 3
FIG. 3a
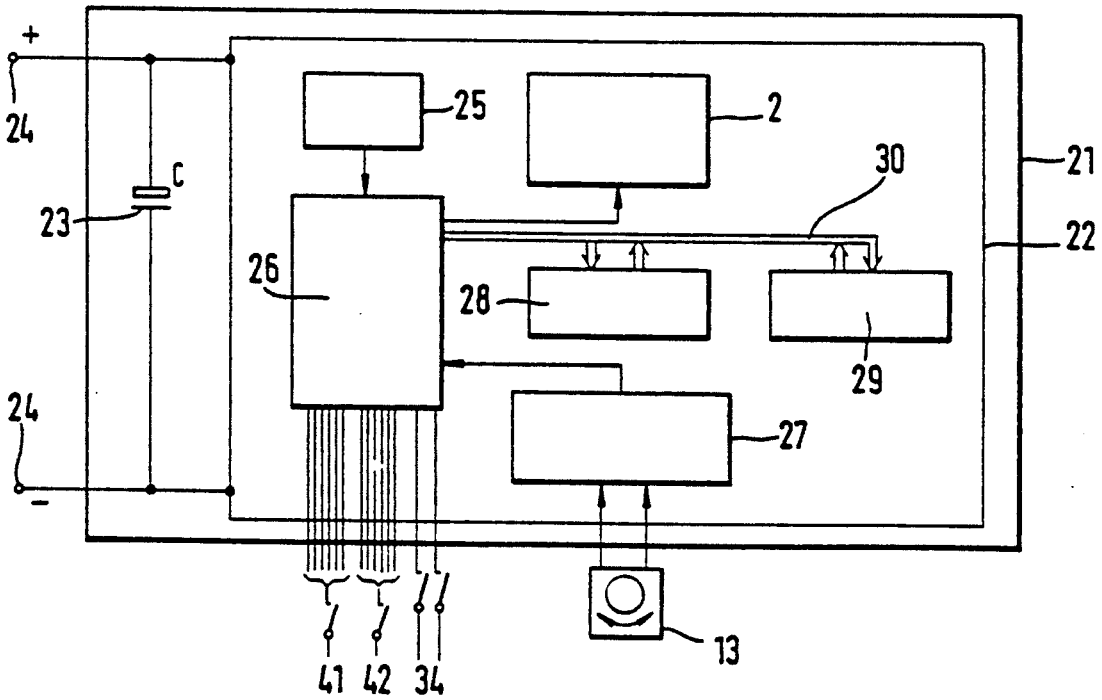

FIG. 4
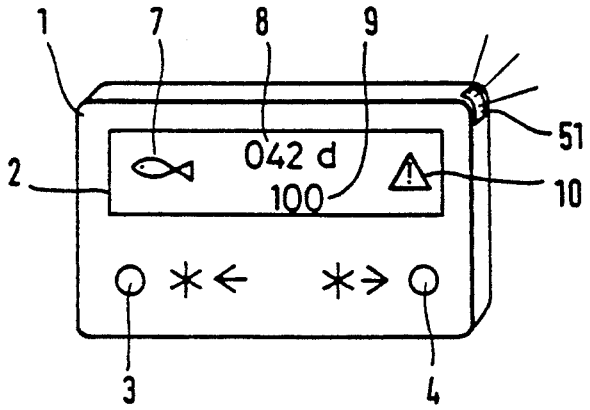
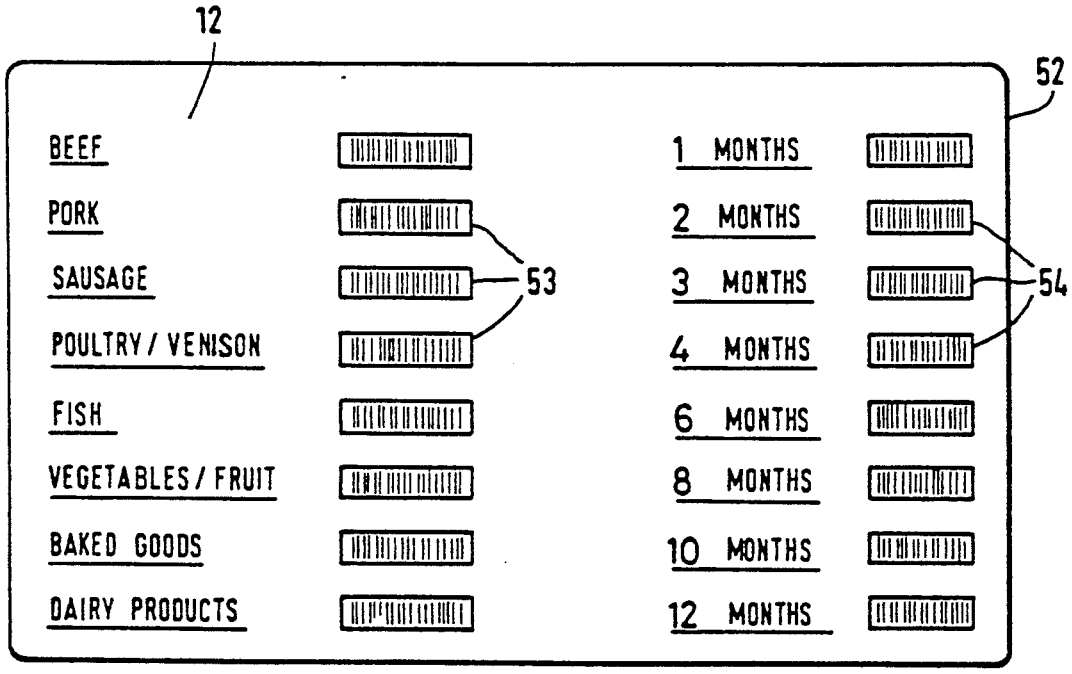
FIG. 4b

ELECTRONIC APPARATUS FOR MONITORING THE REMAINING STORAGE PERIOD OF FROZEN FOODS

This is a continuation of copending application Ser. No. 553,889 filed on Jul. 13, 1990 now abandoned.

BACKGROUND OF THE INVENTION

1. Field of the Invention

The present invention relates to an electronic apparatus for monitoring the remaining storage period of frozen foods.

Frozen comestibles are usually provided with an expiration date; or, in essence, comestibles or foods which are frozen by the homemaker herself are equipped with a label or tag which lists the type of the commodity and/or the expiration date thereof. However, in maintaining a supply in a filled, freezer, it is possible to quickly lose the ability of monitoring at which point in time which particular commodity has reached its expiration date. The monitoring and the searching out of the respective commodity or comestible in this manner is not especially effective, and is burdened with a high degree of uncertainty with regard to the searching out of the commodity whose remaining storage period has already expired.

SUMMARY OF THE INVENTION

Accordingly, it is an object of the present invention to propose the provision of an apparatus through the utilization of which it is possible to implement a simple and assured monitoring of the storage period of frozen comestibles or merchandise.

The foregoing object is achieved through the intermediary of an apparatus as described herein, in which there is provided an electro-optical display, a control electronics with a memory or data storage, input elements for entering the data with regard to the frozen foods (type of commodity, remaining storage period) as well as one switch element for initiating the storage of the data in the apparatus, and wherein subsequent to the input of the data regarding a commodity which is to be newly stored, there appears on the display an identification number which has not been taken as yet and which is assigned to these data, which is to be applied onto the commodity and serves for the later identification thereof in the freezer; and wherein, after the expiration of the remaining storage period, there is generated an applicable warning signal.

The invention commences from the concept that the characterizing data of the frozen commodity or comestible, namely the type of the merchandise; for example, such as beef, and the remaining storage period, are entered into the monitoring apparatus and an identification number is issued by the latter, which internally of the apparatus is assigned to the entered data and which, on the other hand, is applied by the homemaker to the applicable goods for their subsequent identification. These data are monitored by the apparatus, and after the expiration of the remaining storage period of the commodity, a warning signal is emitted by the apparatus. This signal can be either optical or acoustic in nature.

Further features of the invention can be ascertained from the detailed description as elucidated hereinbelow. Upon the removal of a commodity or foodstuff item from the freezer, the respective data for the commodity must be erased in the monitoring apparatus. For this purpose, the identification number is entered into the apparatus by means of an entry or input element and, for a short period of time, the corresponding commodity data are displayed on the display, while on the other hand, the data are erased in the main memory storage. However, in accordance with a preferred modification of the invention, although the data are erased in the main memory or data storage, they are transferred into an interim memory or data storage and therein maintained stored therein until the subsequent erasing procedure. This has the purpose that for a frozen commodity which is not yet to be finally be removed from the freezer, although its data have been already erased in the main memory storage, to again "freshen up" or reenter these data in the apparatus without any new input. For this purpose, the data are again re-transferred or recorded from the interim data storage into the main data storage upon actuation of the two applicable switch elements.

The apparatus is preferably equipped with a rechargeable battery and with security for preserving the entered data in the event of a power outage in the form of a nonvolatile energy storage and/or energy-storage capacitance.

Hereinbelow there are more closely elucidated four possible embodiments of such apparatus, wherein it is common to all of them that the type of commodity and the remaining storage period of the commodities or foodstuffs which are to be stored are entered in the apparatus, there is actuated a switch element which is associated with the commodity storing procedure and which assumes the storage of the entered data and that as a result thereof, there appears an identification number on the display. The apparatus is hereby constructed in such a manner as to presently emit a not yet assigned lowest number from a supply; for example, of 150 to 200 numbers.

Upon the removing of one of the commodities from the freezer, there is thereafter entered the identification number in the monitoring apparatus by means of an applicable control or setting element and represented on the display. Concurrently there appear the type of commodity and the still available remaining storage period for this foodstuff, which is reduced within the apparatus in a 24-hour rhythm or cycle by presently incrementally one day. Thereafter, a switch element which is associated with the commodity procedure is actuated, whereupon the data which is stored in the main memory storage are erased and transferred into the interim data storage.

In the event that a commodity, after removal thereof from the freezer, after the data associated therewith have already been erased in the apparatus, should once again be returned to the freezer and continue to be monitored, then the two above-mentioned switch elements are concurrently actuated and the interim stored data are again retransmitted into the main memory storage.

As long as data are entered into the apparatus or erased therein, the data for these commodities are indicated on the display. After a period of time which is specified by the apparatus; for example 15 seconds, there appear on the display the data or that particular commodity with the shortest remaining storage period which is still available.

Pursuant to a preferred embodiment, the apparatus contemplates that upon the selection of a type of commodity or foodstuff; for example, such as a vegetable, that for a specified period of time there is displayed the commodity with the shortest still available remaining storage period for this selected type of commodity.

When, in connection with the foregoing, there is presently described the actuation of the switch elements for the commodity storage or respectively removal after the entry of data regarding the type of commodity and the remaining storage period; in essence, the identification number, then within the scope of the invention, without requiring anything further, it becomes possible to initially actuate these switch elements and thereafter to enter the applicable data.

The apparatus possesses a timer circuit which limits itself to relative time; in essence, there are displayed only periods of time; namely, remaining storage periods. Within the context of the invention it would be possible to install a timer in the apparatus and additionally besides the remaining storage period, also instead thereof, to display the actual expiration date.

BRIEF DESCRIPTION OF THE DRAWINGS

Reference may now be had to the following detailed description of four exemplary embodiments of the invention, taken in conjunction with the accompanying drawings; in which:

FIG. 1 illustrates the front side of a monitoring an apparatus of a first embodiment pursuant to the invention;

FIG. 1*a* is a block circuit diagram of a circuit arrangement for implementing the operation of the apparatus of FIG. 1;

FIG. 2 illustrates the front side of an apparatus constructed pursuant to a second embodiment of the invention;

FIG. 2*a* illustrates the block circuit arrangement for the apparatus of FIG. 2;

FIG. 3 illustrates the front side of an apparatus of a third embodiment;

FIG. 3*a* illustrates the block circuit arrangement associated with the apparatus of FIG. 3;

FIG. 4 illustrates the front side of an apparatus constructed pursuant to a fourth embodiment;

FIG. 4*b* illustrates an indicator plate with line or bar codes; and

DETAILED DESCRIPTION

Figure 4A:
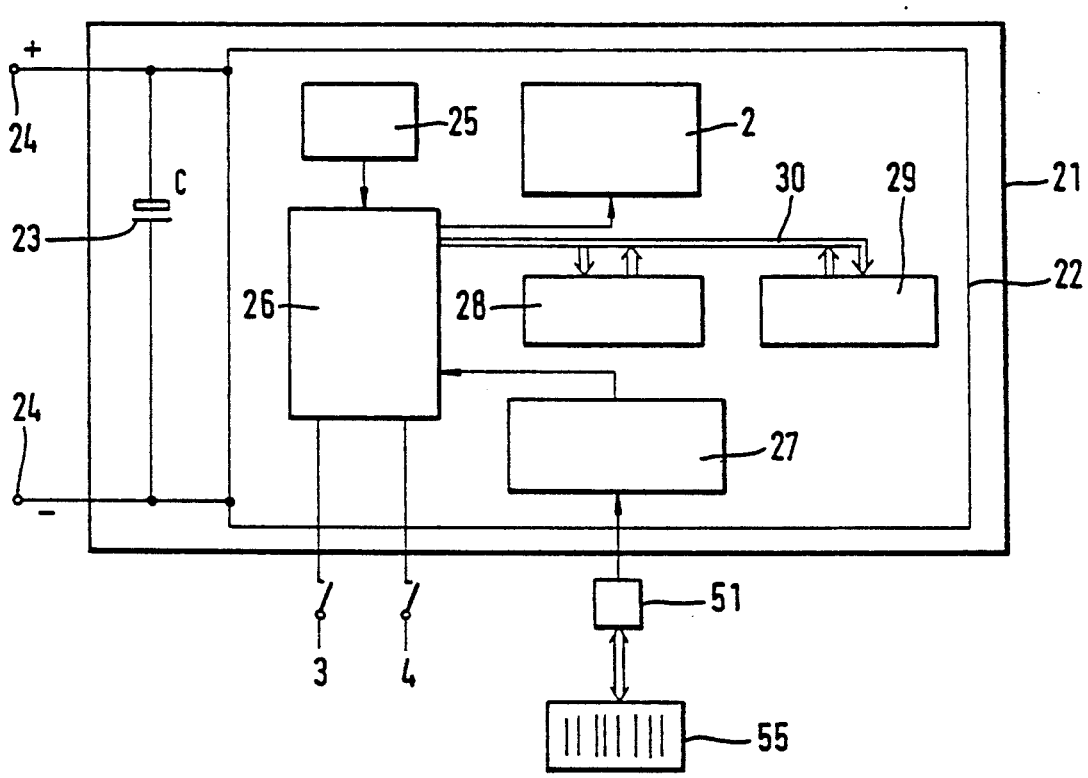
FIG. 4*a* illustrates the block circuit arrangement associated with the apparatus of FIG. 4.

In FIG. 1 of the drawings there is represented an apparatus 1 with an electro-optical display 2; for example, an LCD display. This apparatus possesses actuating buttons (switch elements) 3 and 4 for the initiation of the entering procedure for the data (storing) and erasing of the data (removal). Furthermore, there are provided buttons 5 and 6 for the entry of the storage period or, in essence, the identification number. Represented on the display 2 are the type of the commodity or foodstuff by means of a symbol 7, the remaining storage period 8, the identification number 9, as well as a warning symbol 10. In addition to the symbols 7, in a further representation line of the display, there can be indicated the number 11 which is associated with one of the applicable types of commodities. Below the display there is arranged a table with a listing of eight different types of commodities or foods and with the recommended storage periods set forth in months. This table is identified by reference numeral 12. Finally, serving for the entry of the storage period and the desired identification number, is a control or setting element 13, which is constructed as a rotary transmitter or selector which produces individual bits for the resetting of the display. The special particularity consists of in that upon the entry of the storage period, the latter is entered in months, and after completion of the entry the apparatus undertakes a recomputation into days and this is represented on the display.

The above-described apparatus, as well as the hereinbelow described exemplary embodiments, are apparatuses which operate independently of the freezer, which are stored independently or separately thereof, but also can be housed in suitable recesses provided in the exterior of the freezer.

In FIG. 1*a*, represented by a block circuit diagram is the electronic control circuit. Within the overall plan of the apparatus 21 there is arranged the electronic control unit 22 as well as an energy-storage capacitance 23, the last-mentioned of which serves as a power or energy reserve during a battery change. The electrical terminals 24 are connected to a battery (not shown). The storage unit possesses an oscillator 25 for generating a pulse, as well as including a microprocessor 26. The last-mentioned microprocessor is activated from externally thereof through the already mentioned actuating buttons 3 through 6. Connected to an input of the microprocessor 26 is an evaluating unit 27 which correspondingly converts the signals from the rotary transmitter 13. Connected to an output of the microprocessor 26 is also a main memory or data storage 28 as well as an interim data storage 29 to which there are transmitted the data which are to be stored by means of a data bus 30. Finally, connected to the output of the microprocessor is the display 2 which is already elucidated in FIG. 1.

The functioning of the apparatus is essentially as follows:

The apparatus, without the need for any further switch activation, is prepared for the receipt of a commodity or food type. For this purpose, the rotary transmitter 13 is turned and there appear in sequence the symbols 7 for the eight types of commodities or foods which are represented on the table 12. Concurrently, or also alternatively, there appears on the display 11 the corresponding number elating the type of the commodity. Thereafter, pressure is exerted against the actuating button 5, so as to indicate that, thereafter, a remaining storage period should be entered. Now, there is introduced, expressed in months, the desired remaining storage period of the selected type of commodity by means of the rotary transmitter or selector 13. After completion of this entry; for example, after 5 seconds, there appears at the reference numeral 8 the remaining storage period, shown recomputed into days. Thereafter, there is pressed the actuating button 3, in order to indicate that data relating to a commodity which is to be newly stored are being entered into the apparatus. Thereafter, on the display 2 there then appears an identification number at the location shown by reference numeral 9; for example, the number "125". This number is inscribed or recorded on the packing for the commodity which is to be stored, or noted on a label which is ascribed to the commodity.

In the event that a commodity or a food item is to be removed from the freezer, there is at first pressed the actuating button 6 and with the rotary selector 13 there is initially set on the display the identification number which is associated with the commodity; for example, the number "125", and the actuating button 4 is pressed. This causes the appearance for a few seconds on the display of the symbols for the type of commodity or food, as well as the still available remaining storage period for this commodity, shown in days. Thereafter, this display disappears and the data are erased in the main data storage 28 and assumed in the interim data storage 29. Thereupon, on a display 2 there appears the commodity with the shortest still available remaining storage period, and with its associated data for the type of commodity or foodstuff, remaining storage period and identification number.

When the remaining storage period, which is presently counted back in a 24-hour rhythm by respectively one day, reaches the value "0" for a commodity, then the warning symbol 10 will blink. Concurrently, there can be emitted an acoustic signal. This signal emission continues for so long until the data relating to the applicable commodity are erased in the apparatus, and the commodity has been removed from the freezer.

Should a commodity or food item, whose data has already been erased from the main data storage, be again returned to the freezer, then after pressing the actuating button 6 there is to be again set the identification number by means of the rotary selector 13 on the display 2. Thereafter, the actuating buttons 3 and 4 are to be simultaneously pressed, which will cause the data relating to this commodity to be recorded or retranscribed from the interim data storage back into the main data storage.

In the exemplary embodiment pursuant to FIG. 2, there is again present on the front side of the apparatus 1 a display 2 as well as the actuating buttons 3 and 4 which passes the sam function as in FIG. 1. Furthermore, there is also provided a rotary selector 13 a well as a table 12 with a listing of the applicable type of commodities or food items. Adjacent the table 12 there is represented a table 31, in which the remaining storage periods are listed in months or, respectively, grouping of months. Adjacent the table 12, associated with each type of commodity, are located actuating buttons 323, as well as illuminatable areas or sectors 33. The actuating buttons 32 serve for the selection of the type of goods, the illuminated sectors 33 indicate optically the selected type of commodity, in that the display 2 does not show any corresponding symbols. A similar kind of arrangement is provided for the remaining storage periods pursuant to the table 31. Adjacent to these there are located actuating buttons 34 and illuminatable sectors 35, whose mode of functioning is analogous to that described hereinabove.

On the display 2 there are representable, in the left-hand field, the identification number, and in the right-hand field the remaining storage period shown in days. The warning signal is emitted upon the expiration of a remaining storage period through the blinking of the display 8 with the numerals "000".

In FIG. 2*a* there is represented the respective circuit arrangement which, up to the actuation of the microprocessor 26, is identical with that disclosed in FIG. 1*a*. Designated by reference numeral 32 are symbolically all of the actuating buttons for the selection of the type of commodity, and with reference numeral 34 symbolically all actuating buttons for the selection of the remaining storage periods.

The mode of functioning of this apparatus is extensively similar with that of the embodiment pursuant to FIG. 1. Through the pressing against one of the actuating buttons 32 there is selected the type of commodity or food item, through actuation of an actuating button 34 the desired remaining storage period, thereafter there is pressed the actuating button 3 (storing or commodity) and the applicable data stored in the apparatus. Thereupon, there is emitted by the apparatus an identification number in the field 9. Should, in contrast therewith, a commodity be removed from the freezer, and the therewith associated data erased from the apparatus, then by means of the rotary selector 13 there is set in the field 9 an identification number, and thereafter the actuating button 4 is pressed, with the result that the corresponding commodity data are erased in the main data storage 28 and assumed by the interim data storage 29.

In this apparatus, for the procedure "storing" there can also be contemplated the following manner of representation. After actuation of a button 32 there will illuminate, as usual, the applicable illuminatable sector 33; is however, on the display 2 there is shown the identification number and the remaining storage period for the commodity with the shortest available remaining storage period of the selected type of commodity. As soon a through a pressing against an actuating button 34; there again illuminates the associated illuminatable sector, there is entered a remaining storage period, then there extinguishes the identification number and the selected remaining storage period appears listed in units of days. As soon as the actuating button 3 is pressed, there is additionally shown on the display 2 the identification number which is to be associated with the selected type of commodity.

For the procedure "removing", there are available the following possibilities. With the rotary selector 13 there is set an identification number in only the field 9. There lights up the illuminatable sector for the type of commodity which is associated with this identification number. Appearing on the display 2 in the field 8 are the available days of the remaining storage period for this commodity or food item. When the (removal) button 4 is thereafter pressed, which for the avoidance of any uncertainties should take place for about 3 seconds, then all displays extinguish after about 3 seconds for a short time, so as to signify that the corresponding data have been erased in the main data storage. Thereafter, there again appear on the display 2 the data for the commodity with the shortest still available remaining storage period.

The exemplary embodiment pursuant to FIG. 3, with the exception of the display 2 which corresponds to that of FIG. 1, is technologically similar to the embodiment pursuant to FIG. 2. For the setting of the type of commodity there do not serve any actuating buttons, but rather a slider switch 41 which is settable within a guide to the individual types of commodities. The remaining storage periods are set by means of a second slider switch 42. The illuminatable sectors 33 are also eliminated; for this purpose and is provided in the display 2 a symbol 7 for the commodity type. Similarly, there are omitted the illuminatable sectors 35; instead thereof, in the field 8 of the display there is given the remaining storage period in months entered, and only after the entry recalculated into days. The circuit arrangement associated therewith is represented in FIG. 3*a* and corresponds with that in FIG. 2*a* with the exception of the display.

Figure 4C:
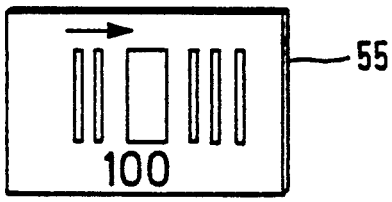
FIG. 4*c* illustrates an identifying label which may be employed with the exemplary embodiment.

In FIG. 4 there is represented an embodiment of an apparatus, in which the input of the data is implemented by means of a light-electric scanner 51. The construction of the apparatus is similar with that of the preceding embodiments, whereby for the same components there are utilized the same reference numerals as employed in FIG. 1. Also the circuit arrangement constructed pursuant to FIG. 4*a* is to a large extent similar to that in this instance the same components are provided with the same reference numerals. The difference resides that, instead of the rotary selector 13, there is provided the above-mentioned light-electric scanner 51, as a result of which the type of the evaluation in the evaluating unit 27 changes in comparison with the other exemplary embodiments.

Arranged on the freezer, or in proximity thereto, is a board 52 which possesses the already-mentioned tables 12 and 31 listing the type of commodities or food items and the remaining storage periods. Serving as a data carrier are the line or bar codes 53 and 54 which are associated with the individual fields, and which are associated with the type of commodities or, respectively, the remaining storage periods. For the new entry of data during the procedure "storing", by means of the scanner 51 travel is carried out across the line or bar codes 53 of the selected type of commodity and thereafter over the desired remaining storage period 54. Thereby, stored in the apparatus are the corresponding data, and the apparatus indicates thereafter in the already described manner, the identification number of the type of commodity. However, now the homemaker must select, from a supply of labels 55, the label with the applicable identification number thereon; for example, the number "100", and apply this to the commodity.

Should this commodity now be removed from the freezer and the corresponding commodity data erased in the apparatus, then by means of the scanner 51 there must be scanned the label which is located on the commodity, whereupon the numeral "100" which is listed on the label in line or bar code is read into the apparatus, and therein the associated commodity data are called up and represented on the display. Thereafter, the actuating button 4 on the apparatus is pressed and the corresponding data erased in the main data storage and assumed in the interim data storage.

The computer has entered and arranged the input data for the different commodities in its memory, wherein the data, in particular, incorporated the remaining storage period for the commodities, with the data being stored in the form of either a list or also in accordance with otherwise, in the technology usual electronic processing criteria, in such a manner that the data relating to the commodity possessing the shortest remaining storage period are located at a first position and maintained in readiness for display. As long as there is not implemented any input of data respecting a commodity which is to be newly stored; there is visually indicated on the display the data relating to the commodity possessing the shortest remaining storage period. However, upon the implementing of a new input of data, in a usual manner, there immediately disappears the previous display, and the new data are indicated on the display during the input procedure; and thereafter, for a short period of time, there is displayed the new identification number for this newly stored commodity. This identification number again disappears from the display after a specified short period of time, and then there again reappears, as before, the display of the data pertaining to the commodity possessing the shortest remaining storage period. This sequence of events is carried out with the usual or normal display techniques employed for computers.

In the previously described exemplary embodiments, there is always given the ability that upon the display of the shortest storage periods which remain available for a selected type of commodity, that after a specified time interval; for example, of 15 seconds, the display switches over to that commodity for which there is indicated the shortest remaining storage period of all commodities.

What is claimed is:

1. Electronic apparatus for monitoring the remaining storage periods of different types of frozen commodities stored in a freezer, comprising:

a. an electro-optical display;

b. a control electronic means, including a control clock timer and a data storage memory for storing data related to each frozen commodity, said data including an identification number associated with each commodity, said identification number serving for the subsequent identification of each said frozen commodity in the freezer, said data further including the type of commodity, and a storage period for the commodity;

c. data entry elements for entering said data related to each frozen commodity into the data storage memory, and at least one switch element actuatable for initiating the entry of said data by said data entry elements into the data storage memory;

d. said control electronics means including means for causing the identification number associated with a newly stored commodity to be displayed on said electro-optical display upon the entry of data on the commodity which is to be newly stored in the freezer, said control electronics means further including means for selectively causing data to be displayed on the electro-optical display regarding a particular commodity, and the particular type of commodity, possessing the shortest remaining storage period for that particular type of commodity, and also including means for generating a warning signal upon the expiration of a storage period of any frozen commodity stored in the freezer.

2. Apparatus as claimed in claim 1, wherein said data entry elements include a data entry element for the entry of an identification number.

3. Apparatus as claimed in claim 1, further including a second switch element for selectively erasing or for the interim storage of data on a commodity which is to be removed from or returned to the freezer for storage.

4. Apparatus as claimed in claim 1, wherein said apparatus is an autonomously operating apparatus having a rechargeable battery, and a non-volatile energy storage means providing power in the event of a power outage.

5. Apparatus as claimed in claim 4, wherein said non-volatile energy storage means includes a power storage capacitance.

6. Apparatus as claimed in claim 3, wherein the control electronics means includes an oscillator for generating pulses, and a microprocessor with a display control having transmitted thereto signals from the data entry elements for the type of commodity and the storage period and signals from the first and second switch elements for the entry or erasing of data, and wherein said data storage memory includes a main data storage memory and an interim data storage memory which are connected with the output of the microprocessor, and an evaluating unit for evaluating the signals from the data entry elements for at least the identification number.

7. Apparatus as claimed in claim 1, wherein said electro-optical display includes displays for a symbol representing the type of commodity, a remaining storage period for a commodity, an identification number of a commodity, and for the warning signal.

8. Apparatus as claimed in claim 1, wherein said electro-optical display comprises means for displaying a remaining storage period and an identification number for a commodity, and each different type of commodity having a separate switch element and a separate illuminatable display associated therewith.

9. Apparatus as claimed in claim 8, wherein the separate switch elements comprise a first slider switch for assuming different switching positions associated with each different type of commodity, and a second slider switch for assuming different switching positions associated with different time storage periods.

10. Apparatus as claimed in claim 1, wherein the data entry elements include a rotary selector data entry element which controls the generating of bits for resetting the display.

11. Apparatus as claimed in claim 1, further including a scanning means for scanning a label bearing a line or bar code for imputing data on the type of commodity and a remaining storage period from a board which includes a plurality of line or bar codes associated with different types of commodities and different storage periods.

* * * * *